US005915464A

United States Patent [19]

Kalbacher et al.

[11] Patent Number: 5,915,464

[45] Date of Patent: Jun. 29, 1999

[54] OPTIONAL FLOW PATH TANK FOR USE IN HEAT EXCHANGERS

[75] Inventors: Klaus Kalbacher, Rangendingen; Manfred Schatz, München; Axel Temmesfeld, Raubling, all of Germany

[73] Assignees: Modine Manufacturing Co., Racine, Wis.; Bayerische Motoren Werke, Munich, Germany

[21] Appl. No.: 08/882,127

[22] Filed: Jun. 25, 1997

[30] Foreign Application Priority Data

Jul. 2, 1996 [DE] Germany ..... 196 26 639

[51] Int. Cl.[6] ..... F28F 27/02

[52] U.S. Cl. ..... 165/97; 165/174; 165/DIG. 123

[58] Field of Search ..... 165/97, 100, 174, 165/DIG. 123

[56] References Cited

U.S. PATENT DOCUMENTS

| | | | |
|---|---|---|---|
| 255,575 | 3/1882 | Bopp | 165/174 |
| 2,487,484 | 11/1949 | Simpelaar | 165/97 |
| 3,990,504 | 11/1976 | Kolthoff, Jr. | 165/40 |
| 5,107,921 | 4/1992 | Tsai | 165/108 |

FOREIGN PATENT DOCUMENTS

| | | | |
|---|---|---|---|
| 3217836 A1 | 5/1982 | Germany . | |
| 19515526 C1 | 4/1995 | Germany . | |
| 19536999 A1 | 10/1995 | Germany . | |
| 446073 | 4/1936 | United Kingdom | 165/97 |

*Primary Examiner*—Allen Flanigan
*Attorney, Agent, or Firm*—Wood, Phillips, VanSanten, Clark & Mortimer

[57] ABSTRACT

Two alternative flow patterns through a heat exchanger core are provided by a tank (20) including a baffle (40) dividing the tank into first and second chambers (42 and 44). A first port (50) is provided in the baffle (40) to establish communication between the chambers (42 and 44). A second port (52) is provided to the second chamber (44). The tank (20) further incudes plugs (62 and 64) that are receivable in the tank (20) for alternatively closing the first port (50) while opening the second port (52), and opening the second port (52) while closing the first port (50).

12 Claims, 3 Drawing Sheets

FIG. 5A
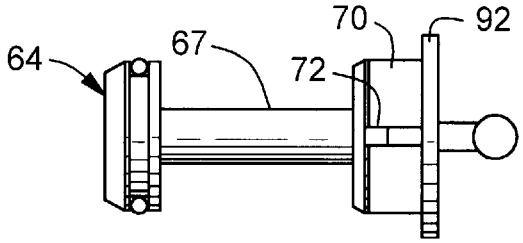
FIG. 5B
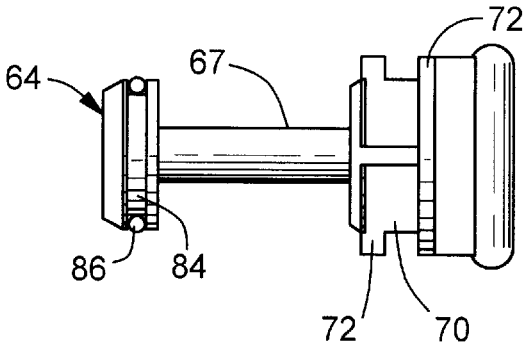
FIG. 6
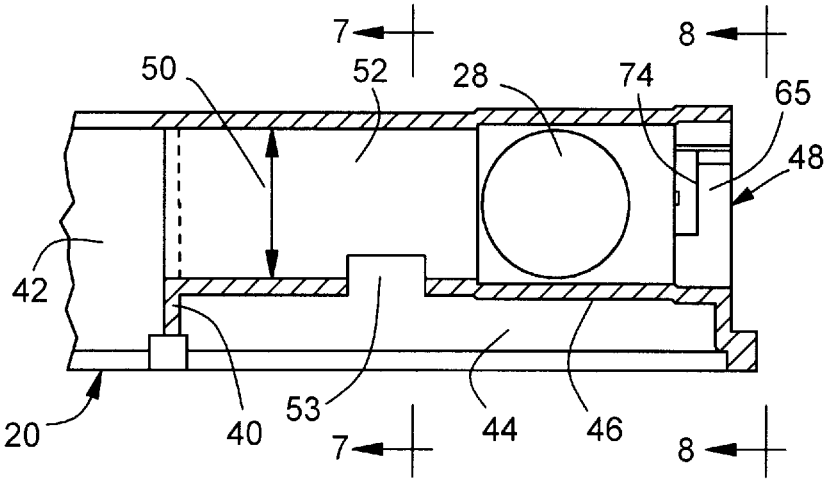
FIG. 7
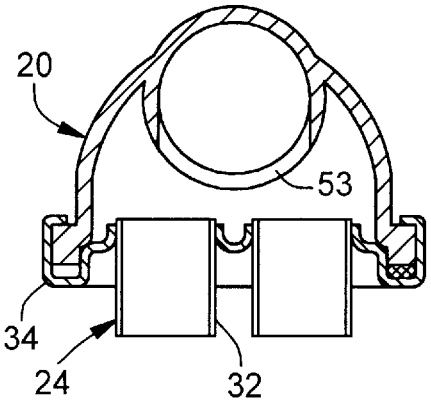
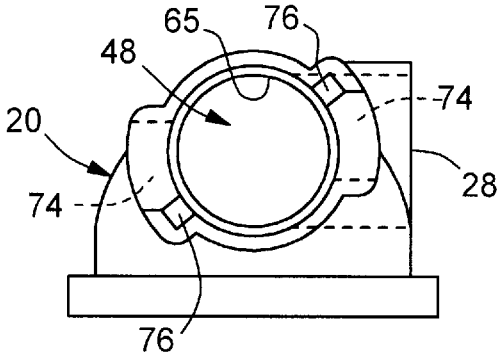
FIG. 8

OPTIONAL FLOW PATH TANK FOR USE IN HEAT EXCHANGERS

FIELD OF THE INVENTION

This invention relates to heat exchangers, and more particularly, to heat exchangers used as radiators in vehicular applications.

BACKGROUND OF THE INVENTION

The use of heat exchangers in the form of radiators to cool the engine and associated components of a vehicle has long been known. Typically, radiators are used to cool a coolant that has been heated by circulation through the engine. Additionally, the radiator may provide cooling or heating for other operating fluids, such as transmission oil and hydraulic fluid.

Commonly, radiators include a pair of tanks arranged on opposite sides of a tube and fin type heat exchanger core. It is also common for the tanks of such heat radiators to be made of plastic that has been formed in dies by injection molding. The cost of the dies is typically a significant factor in radiator design and for this reason there is a continuing desire to reduce the cost associated with such dies.

Additionally, there are at least two types of radiators that are desirable. In the first type of radiator, the coolant flows into an inlet provided in one of the tanks, makes a single pass through the radiator core, and then flows out of an outlet provided in the other tank. In the second type of radiator, a low temperature region is provided within the radiator by using a tank having a baffle which forces part of the coolant to make an additional pass through the radiator, thereby cooling that portion of the coolant to a lower temperature. The single pass type radiator is advantageous in some vehicle applications, while the low temperature region type radiator is advantageous in other vehicle applications.

Because conventional radiators require different tank designs for each type of radiator, it is difficult to reduce the cost associated with the tanks and their related dies when it is desired to provide both types of radiator Accordingly, there is a need for a heat exchanger, especially a radiator tank for a vehicle that can be selectively configured to provide either single pass operation or low temperature region operation.

SUMMARY OF THE INVENTION

It is the principal object of the invention to provide a new and improved tank for use in heat exchangers, especially vehicle radiators. Specifically, it is an object of the invention to provide a tank that allows fluid flow through a heat exchanger core to be distributed in either of two desired flow patterns. More specifically, it is an object of the invention to provide a radiator that will operate with or without a low temperature region while utilizing essentially the same individual parts.

According to one facet of the invention, a tank for use with a heat exchanger core having a plurality of tubes terminating in a header is provided. The tank includes a tank body having an open side adapted to be closed by a header of a heat exchanger core, and a baffle in the tank that is adapted to divide the tank into first and second chambers. The tank further includes a first port in the baffle establishing fluid communication between the chambers, a second port to the second chamber, and plug structure receivable in the tank for alternatively (a) closing the first port while opening the second port and (b) opening the second port while closing the first port. Fluid flowing through a heat exchanger core connected to the tank flows in a first flow pattern with the plug structure closing the first port while opening the second port, and flows in a second, different flow pattern with the plug structure opening the second port while closing the first port.

According to another facet of the invention, a tank is provided for distributing fluid flow through a heat exchanger core in either of two desired flow patterns. The tank includes a first chamber, a second chamber, a first port connecting the chambers to allow fluid flow between the chambers, and a second port for allowing fluid flow to and from the tank through the second chamber. The first port is configured to receive a first plug that restricts the fluid flow through the first port to cause fluid flow through a heat exchanger core in a first desired flow pattern. The second port is configured to receive a second plug that restricts fluid flow through the second port to cause fluid flow through a heat exchanger core in a second desired flow pattern.

According to yet another facet of the invention, a tank is provided for causing fluid flow through a heat exchanger core in either of two desired flow patterns. The tank includes a first chamber, a second chamber, a first port on the tank for allowing fluid flow between the chambers, a second port on the tank for allowing fluid flow to and from the tank, a first plug, and a second plug. The first plug is configured for insertion into the first port to restrict the fluid flow through the first port and allow fluid flow through the second port to distribute fluid flow through a heat exchanger core and a first desired flow pattern. The second plug is configured for insertion into the second port to restrict the fluid flow through the second port and allow fluid flow through the first port to distribute fluid flow through a heat exchanger core and a second desired flow pattern.

Other objects and advantages will become apparent from the following specification taken in connection with the accompanying drawings.

BRIEF DESCRIPTION OF THE DRAWINGS

FIGS. 5A and 5B are elevation views of the second plug shown in FIG. 3B;

FIG. 6 is a view similar to FIGS. 3A and 3B, but showing the plugs removed from the heat exchanger;

FIG. 7 is a view taken along the line 7—7 in FIG. 6; and

FIG. 8 is a view taken along the line 8—8 in FIG. 6.

DETAILED DESCRIPTION OF THE PREFERRED EMBODIMENT

Figure 1:
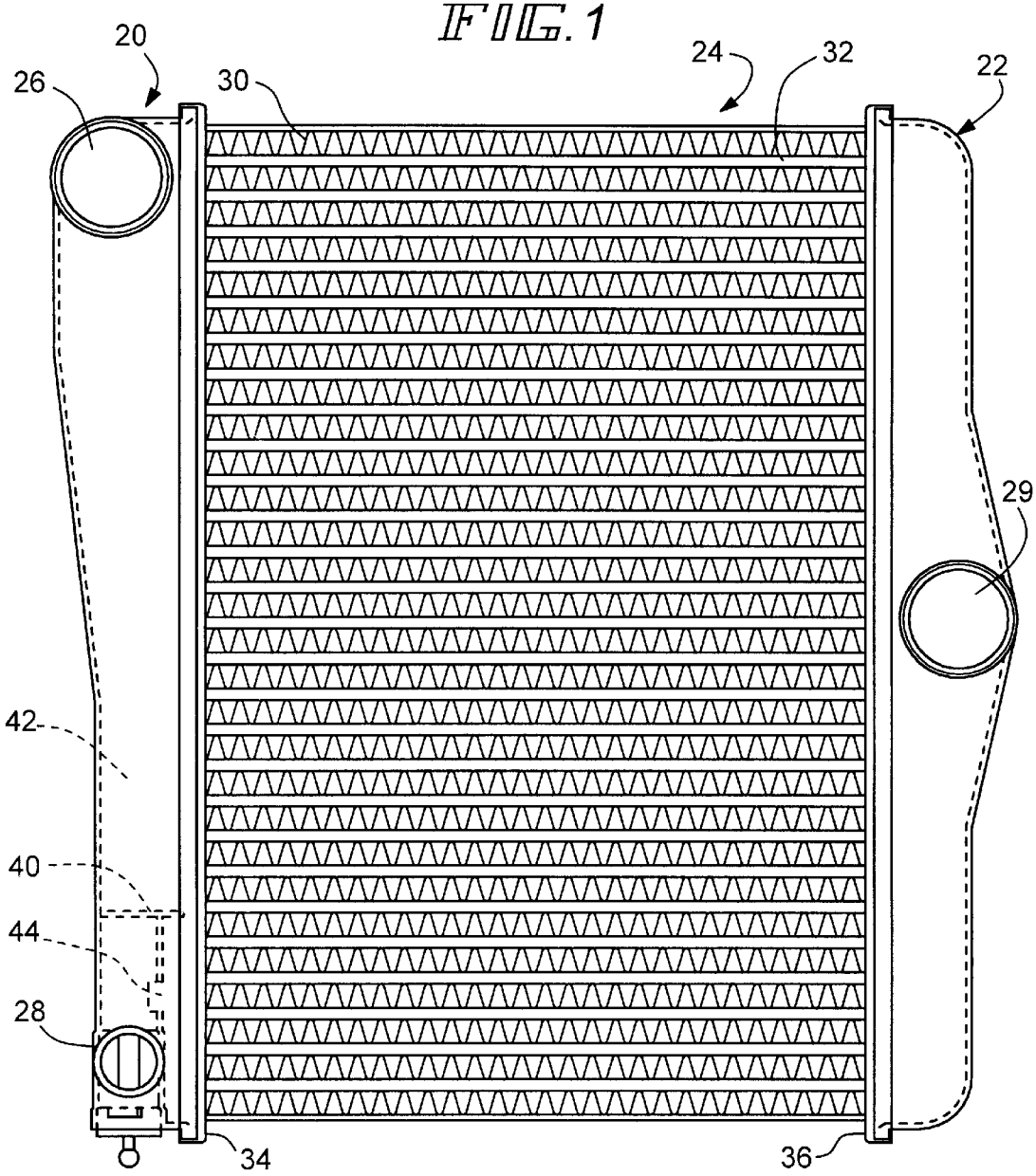
FIG. 1 is an elevation of a heat exchanger in the form of a radiator embodying the invention.
Figure 2:
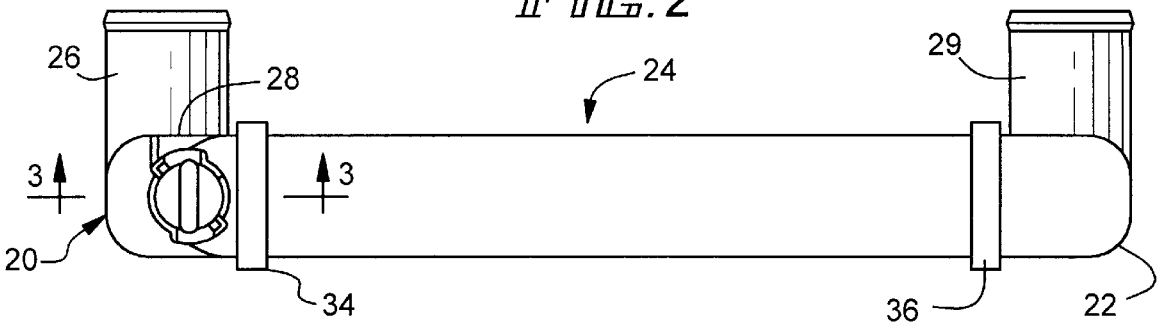
FIG. 2 is a bottom view of the heat exchanger shown in FIG. 1.

An exemplary embodiment of a heat exchanger made according to the invention is described herein and is illustrated in the drawings in the form of a radiator for use in the engine coolant system of a vehicle. However, it should be understood that the invention may find utility in other applications, and that no limitation to use as a radiator is intended.

As seen in FIG. 1, the radiator includes a pair of tanks 20 and 22 connected to opposite ends of a tube and fin exchanger core 24. A coolant inlet 26 and a coolant outlet 28 are provided on the tank 20. Another coolant outlet 29 is provided on the tank 22. The core includes a plurality of serpentine fins 30 located between a plurality of flat tubes 32. The opposite ends of the tubes 32 are liquid tightly sealed to headers 34 and 36. The headers 34 and 36 serve to connect the tubes 32 to the tanks 20 and 22, and to seal the open sides of the tanks 20 and 22.

The core 24, as well as the rest of the radiator, may be either a brazed or a mechanically joined assembly. However, it is preferred that the core be brazed and that the tanks 20 and 22 be made of plastic.

Figure 3A:
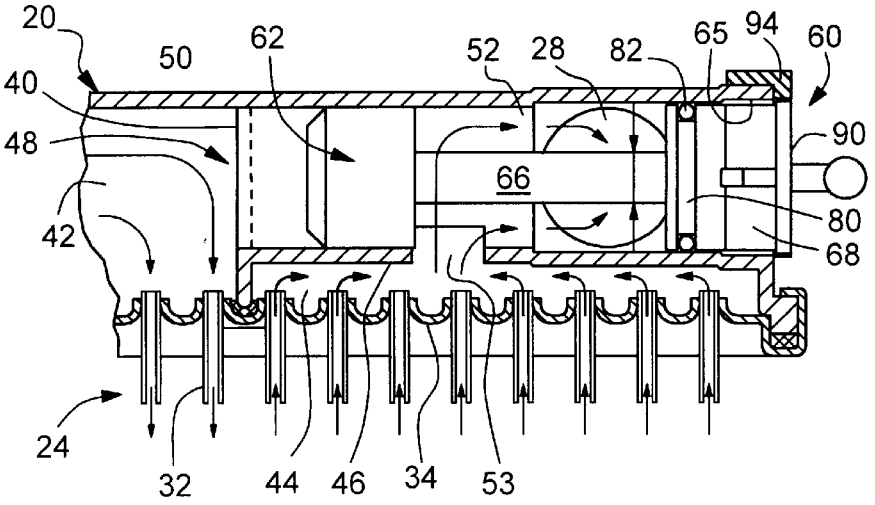
FIG. 3A is an enlarged, rotated, partial sectional view taken along the line 3—3 in FIG. 2 showing a first plug inserted into the heat exchanger.
Figure 3B:
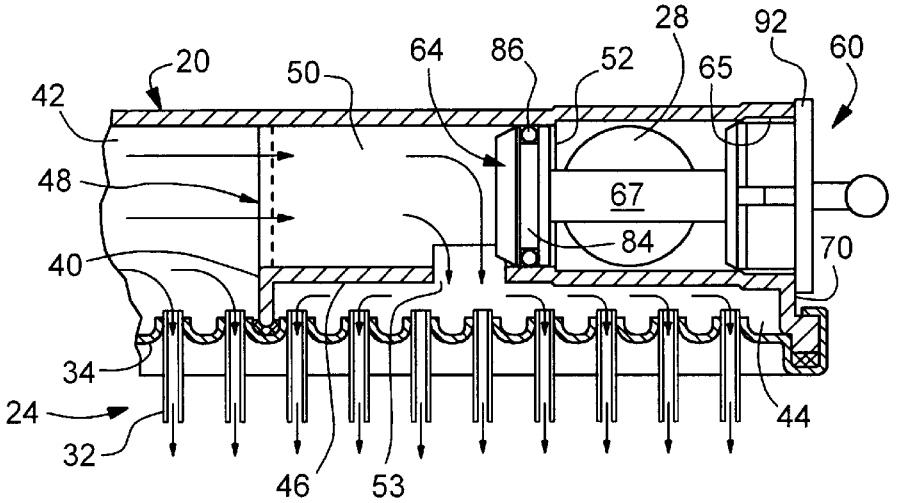
FIG. 3B is another enlarged, rotated, partial sectional view taken along line 3—3 in FIG. 2, but showing a second plug inserted into the heat exchanger.

As seen in FIGS. 3A and 3B, the tank 20 includes a baffle 40 that divides the tank into a first chamber 42 and a second chamber 44. A conduit 46 is located in the second chamber 42 extending from the baffle 40. Preferably, the baffle 40 and the conduit 46 are formed as a unitary piece with the tank 20. The conduit 46 includes a cylindrical fluid passage 48 with a first port 50 and a second port 52. An opening 53 is formed in the conduit 46 to allow fluid flow between the passage 48 and the second chamber 44. The first port 50 extends through the baffle 40 to allow fluid flow between the first and second chambers 42 and 44. The second port 52 connects the second chamber 44 to the outlet 28 to allow fluid flow to exit the tank 20 through the second chamber 44.

As best seen in FIGS. 3A and 3B, means 60 are provided in the form of a first plug 62 and a second plug 64 for alternatively (a) closing the first port 50 while opening the second port 52 and (b) opening the second port 52 while closing the first port 50. More specifically as best seen in FIG. 3A, the first port 50 and the plug 62 have substantially conforming cylindrical shapes so that the first plug 62 may be received in the first port 50 to block fluid flow through the first port 50. Because the first plug 62 does not block the second port 52, fluid flow is allowed between the second chamber 44 and the outlet 28. Similarly, the second port 52 and the second plug 64 have substantially conforming cylindrical shapes so that the second plug 64 may be received in the second port 52 to block the fluid flow through the second port 52 to the outlet 28. Because the second plug 64 does not block the first port 50, fluid flow is allowed between the first and second chambers 42 and 44.

Preferably, as best seen in FIG. 6, the passage 48 includes an opening 65 to the exterior of the tank 20 so that the plugs 62 and 64 may be inserted and removed after the tank 20 has been assembled to the core 24. The opening 65 also can serve as a drain for the coolant. As best seen in FIGS. 4A, 4B, 5A, and 5B, the plugs 62 and 64 are provided with cylindrical support stems 66 and 67 connected to heads 68 and 70, respectively, that may be screwed or locked in the opening 65 to maintain the respective plugs 62 and 6A in the correct position. Preferably, the heads 68 and 70 are locked in the opening 65 by tabs 72 provided on each of the heads 68 and 70 to engage slots 74 provided in the opening 65. The tabs 72 are inserted through openings 76 leading to the slots 74. The plugs 68 and 70 are then rotated to engage the tabs 72 in the slots 74 and lock the plugs 62 and 64 in the passage 48.

Figure 4A:
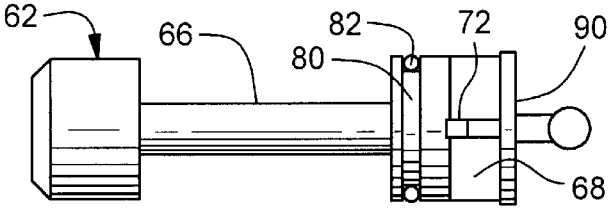
FIGS. 4A and 4B are elevation views of the first plug shown in FIG. 3A.
Figure 4B:
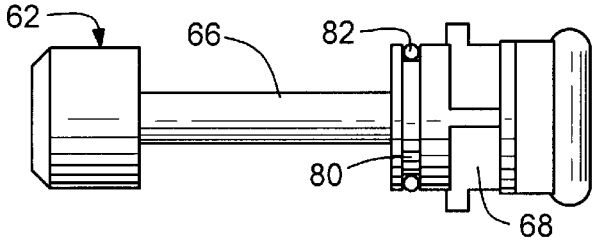

As best seen in FIGS. 3A, 4A, and 4B, the head 68 of plug 62 has an annular groove 80 that receives an O-ring 82 which seals the opening 65 to prevent coolant leakage from the tank 20. Similarly, as best seen in FIGS. 3B, 5A, and 5B, the plug 64 includes an annular groove 84 that receives an O-ring 86 which seals the second port 52 to prevent coolant leakage from the tank 20 through the outlet 28 and the opening 65.

Preferably, as best seen in FIGS. 4A, 4B, 5A, and 5B, caps 90 and 92 are formed on the heads 68 and 70, respectively. The cap 90 has a smaller diameter than the cap 92 to help insure that the desired plug 62 or 64 is inserted into the tank 20. In this regard, as best seen in FIG. 3A, a blocking tab 94 can be attached to the tank 20 adjacent the opening 65 to insure that only the plug 62 may be inserted into the passage 48 when the plug 62 is the desired plug.

In operation, the plug 62 is inserted into the tank 20 when a radiator having a low temperature region is desired. As shown by the arrows in FIG. 3A, the plug 62 allows a portion of the coolant to flow from the first chamber 42 through the core 24 to the tank 22 and then back from the tank 22 through the core 24 to the second chamber 44. The portion of the coolant flow then exits the tank 20 through the second port 52 and the outlet 28. Alternatively, the plug 64 is inserted into the tank 20 when a single pass radiator is desired As shown by the arrows in FIG. 3B, the plug 64 allows the coolant to flow in a single pass from the tank 20 through the radiator core 24 to the tank 22 to exit from the outlet 29.

It should be appreciated that by providing the tank 20 with chambers 42 and 44, the ports 50 and 52, and the plugs 62 and 64, the tank 20 may be used to alternatively form a radiator with or without a low temperature region. This eliminates the need to produce two different tanks. Further, if the tank 20 is manufactured from molding dies, only one set of tank molding dies is required to produce radiators with and without low temperature regions.

We claim:

1. A tank for use with a heat exchanger core having a plurality of tubes terminating in a header to which the tank is attached, comprising:

a tank body having an open side adapted to be closed by a header of a heat exchanger core;

a baffle in the tank and adapted to divide the tank into first and second chambers, a first port in said baffle establishing fluid communication between said chambers;

a second port to said second chamber; and plug means receivable in the tank for alternatively (a) closing said first port while opening said second port and (b) opening said second port while closing said first port;

whereby fluid flow through a heat exchanger core is distributed in a first flow pattern with the plug means closing said first port while opening said second port, and distributed in a second flow pattern with the plug means opening said second port while closing said first port.

2. The tank of claim 1 wherein said plug means comprises a first plug and a second plug that are alternatively inserted into the tank.

3. The tank of claim 2 further comprising a passage in said tank body for alternatively receiving said plugs.

4. The tank of claim 3 wherein said passage has an opening to the exterior of said tank body and said plugs include means for locking said plugs in said opening and means for sealing said opening.

5. The tank of claim 1 wherein the tank is elongated and further includes a conduit for receiving said plug means.

6. A tank for distributing fluid flow through a heat exchanger core in either of two desired flow patterns, the tank comprising:

a first chamber;

a second chamber;

a first port connecting said chambers to allow fluid flow between said chambers, the first port configured to receive a first plug that restricts fluid flow through the first port to distribute fluid flow through a heat exchanger core in a first desired flow pattern;

a second port to allow fluid flow to and from said tank through said second chamber; a third port connecting said second chamber and said second port to allow fluid flow between said second chamber and said second port, the third port configured to receive a second plug that restricts fluid flow through the third port to distribute fluid flow through a heat exchanger core in a second desired flow pattern;

a fourth port configured to allow one of the first and second plugs to be disposed therethrough so as to be received by one of the first and second ports.

7. The tank of claim 6 wherein said ports are in a passage formed in said tank.

8. The tank of claim 6 further comprising a baffle formed in said tank separating said chambers, and wherein said first port is formed in said baffle.

9. The tank of claim 6 further comprising a first plug to be disposed through the fourth port and received in the first port and a second plug to be disposed through the fourth port and received in the third port.

10. A tank for distributing fluid flow through a heat exchanger core in either of two desired fluid flow patterns, the tank comprising:

a first chamber;

a second chamber, a first port on the tank for allowing fluid flow between said chambers, a second port on said tank for allowing fluid flow to and from said tank, a first plug configured for insertion into said first port to restrict the fluid flow through the first port and allow fluid flow through the second port to distribute fluid flow through a heat exchanger core in a first desired flow pattern; and a second plug configured for insertion into said second port to restrict the fluid flow through the second port and allow fluid flow through the first port to distribute fluid flow through a heat exchanger in a second desired flow pattern.

11. The heat exchanger of claim 10 further comprising a passage in said tank for alternatively receiving said plugs, said passage including said ports.

12. The heat exchanger of claim 10 wherein said passage is formed in said second chamber.

* * * * *

UNITED STATES PATENT AND TRADEMARK OFFICE

CERTIFICATE OF CORRECTION

PATENT NO. : 5,915,464
DATED : June 29, 1999
INVENTOR(S) : Klaus Kalbacher, Manfred Schatz and Axel Temmesfeld It is certified that error appears in the above-identified patent and that said Letters Patent is hereby corrected as shown below:

Column 1,
Line 67, change "opening" to -- closing --; change "closing" to -- opening --.

Column 2,
Line 5, change "opening" to -- closing --; change "closing" to -- opening --.

Column 3,
Line 35, change "opening" to -- closing --;
Line 36, change "closing" to -- opening --.

Column 4, claim 1,
Line 49, change "opening" to -- closing --; change "closing" to -- opening --.

Signed and Sealed this

Nineteenth Day of March, 2002

*Attest:*

*Attesting Officer*

JAMES E. ROGAN
*Director of the United States Patent and Trademark Office*